US009837744B2

(12) United States Patent
Ogihara

(10) Patent No.: US 9,837,744 B2
(45) Date of Patent: Dec. 5, 2017

(54) FEMALE TERMINAL WITH RESILIENT PIECE HAVING CONTACT MARK AND A SLIDE CONTACT MARK THAT DO NOT OVERLAP SO THAT CONTACT RESISTANCE WITH A MALE TERMINAL IS LOW

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Shigeru Ogihara, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/316,298

(22) PCT Filed: Jun. 8, 2015

(86) PCT No.: PCT/JP2015/066439
§ 371 (c)(1),
(2) Date: Dec. 5, 2016

(87) PCT Pub. No.: WO2015/198843
PCT Pub. Date: Dec. 30, 2015

(65) Prior Publication Data

US 2017/0162971 A1 Jun. 8, 2017

(30) Foreign Application Priority Data

Jun. 26, 2014 (JP) ..... 2014-131019

(51) Int. Cl.
*H01R 11/22* (2006.01)
*H01R 13/11* (2006.01)

(52) U.S. Cl.
CPC ..... *H01R 13/113* (2013.01)

(58) Field of Classification Search
CPC ..... H01R 13/2442
(Continued)

(56) References Cited

U.S. PATENT DOCUMENTS 3,867,008 A * 2/1975 Gartland, Jr. ..... H01R 13/113 439/857
5,645,459 A * 7/1997 Fitting ..... H01R 13/11 439/852

(Continued)

FOREIGN PATENT DOCUMENTS

| | | |
|---|---|---|
| JP | 10-503319 | 3/1998 |
| JP | 2009-21187 | 1/2009 |
| WO | 2013/172457 | 11/2013 |

OTHER PUBLICATIONS

International Search Report dated Aug. 25, 2015.

*Primary Examiner* — Phuong Dinh
(74) *Attorney, Agent, or Firm* — Gerald E. Hespos; Michael J. Porco; Matthew T. Hespos

(57) ABSTRACT

A female terminal (10) disclosed by this specification is a female terminal (10) with a resilient piece (23, 26) to be resiliently brought into contact with a male terminal (11). The resilient piece (23, 26) is displaceable between an initial position where the resilient piece is located before the male terminal (11) contacts and a deformation position where the resilient piece (23, 26) is resiliently deformed by the contact of the male terminal (11) therewith. A contact mark (35) formed on a point where a contact pressure generated between the resilient piece (23, 26) located at the initial position and the male terminal (11) is maximized and a slide (Continued)

contact mark (36) formed by the slide contact of the male terminal (11) with the resilient piece (23, 26) displaced to the deformation position are arranged not to overlap each other.

4 Claims, 14 Drawing Sheets

(58) Field of Classification Search
USPC ..... 439/856, 857, 858
See application file for complete search history.

(56) References Cited

U.S. PATENT DOCUMENTS

| | | | | |
|---|---|---|---|---|
| 5,685,746 | A * | 11/1997 | Maejima | H01R 13/18 439/845 |
| 5,941,740 | A | 8/1999 | Neuer et al. | |
| 6,652,322 | B2 * | 11/2003 | Ito | H01R 12/721 439/637 |
| 7,556,543 | B2 * | 7/2009 | Weber | H01R 4/2454 439/857 |
| 8,616,925 | B2 * | 12/2013 | Kobayashi | H01R 13/113 439/845 |
| 2015/0133004 | A1 | 5/2015 | Uno et al. | |

* cited by examiner

FEMALE TERMINAL WITH RESILIENT PIECE HAVING CONTACT MARK AND A SLIDE CONTACT MARK THAT DO NOT OVERLAP SO THAT CONTACT RESISTANCE WITH A MALE TERMINAL IS LOW

BACKGROUND

1. Field of the Invention

The present invention relates to a female terminal.

2. Description of the Related Art

FIG. 14 of this specification shows a known female terminal 1 with an embossed projection 3 provided on a spring portion 2 to clarify a contact position of a male terminal and the female terminal. As a male terminal 4 is inserted into the female terminal 1, the male terminal 4 butts against a skirt portion 5 of the projection 3 when starting to move onto the projection 3. Accordingly, a contact pressure is generated and a peak is reached while the male terminal is moving onto the projection 3. Specifically, this peak contact pressure is larger than a contact pressure at a top portion 6, which is a final contact position with the male terminal 4. Thus, if a point where the contact pressure peaks and the top portion 6 are arranged very close to each other, the top portion 6 is also subject to plating wear and contact resistance on the top portion 6 may increase. Japanese Unexamined Patent Publication No. 2009-21187 discloses a female terminal that is designed to reduce an insertion force.

However, even if the female terminal described in Japanese Unexamined Patent Publication No. 2009-21187 can reduce an insertion force, a projecting portion to be brought resiliently into contact with the male terminal is an embossed projection and it remains unchanged that a point where a contact pressure peaks and a top portion are arranged very close to each other. Thus, there is a possibility that plating wear occurs from the point where the contact pressure peaks to the top portion and contact resistance increases.

SUMMARY

A female terminal disclosed in this specification has a resilient piece to be brought resiliently into contact with a male terminal. The resilient piece is displaceable between an initial position where the resilient piece is located before the male terminal contacts and a deformation position where the resilient piece is deformed resiliently by the contact of the male terminal therewith. A contact mark formed on a point where a contact pressure generated between the resilient piece and the male terminal is maximized and a slide contact mark formed by the slide contact of the male terminal with the resilient piece displaced to the deformation position are arranged not to overlap each other. Thus, an increase of contact resistance can be suppressed as compared to the case where the contact mark and the slide contact mark overlap each other, i.e. the contact mark and the slide contact mark are arranged very close to each other.

When A denotes the size of the contact mark in an arrangement direction of the contact mark and the slide contact mark, B denotes the size of the slide contact mark in the arrangement direction and C denotes a distance between centers of the contact mark and the slide contact mark in the arrangement direction, a configuration satisfying $C>(A+B)/2$ may be adopted.

According to this configuration, the size A of the contact mark and the size B of the slide contact mark may, for example, be measured in advance and the distance C between the centers may be set based on the measured sizes A, B. Then, the shape of the resilient piece may be appropriately set based on the distance C between the centers.

According to the female terminal disclosed by this specification, it is possible to suppress an increase of contact resistance.

DETAILED DESCRIPTION

Figure 1:
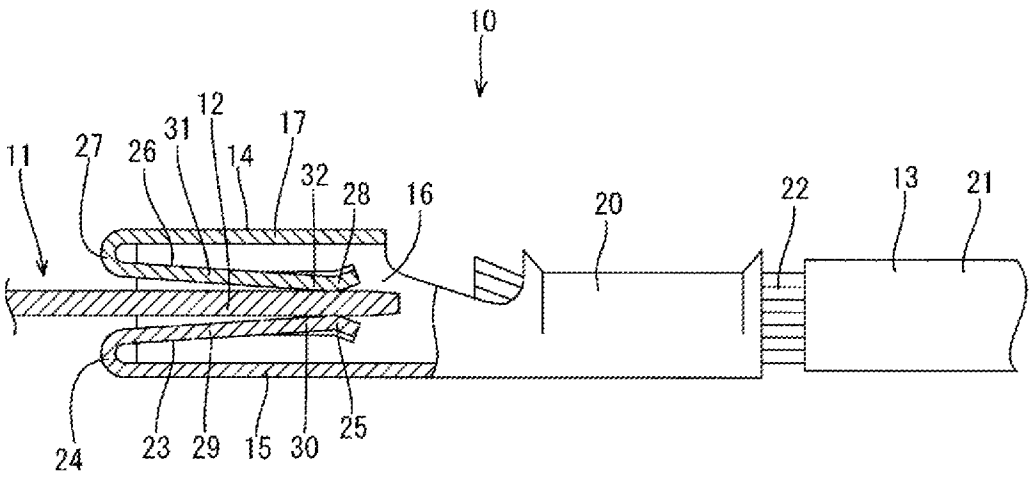
FIG. 1 is a side view partly in section of a female terminal.

An embodiment is described with reference to FIGS. 1 to 13. As shown in FIG. 1, a female terminal 10 according to this embodiment is electrically connected to a male terminal 11. Note that, in the following description, left and right sides in FIG. 1 are respectively referred to as front and rear sides. Further, a vertical direction is also based on FIG. 1.

(Male Terminal 11)

The male terminal 11 is formed by press-working a metal plate material into a predetermined shape. The male terminal 11 includes a male tab 12 in the form of a long and narrow plate, and contact surfaces of the male terminal 12 with the female terminal 10 are flat surfaces. Although the male terminal 11 is connected to an end of a wire in this embodiment, it may be connected to an unillustrated device.

(Female Terminal 10)

Figure 2:
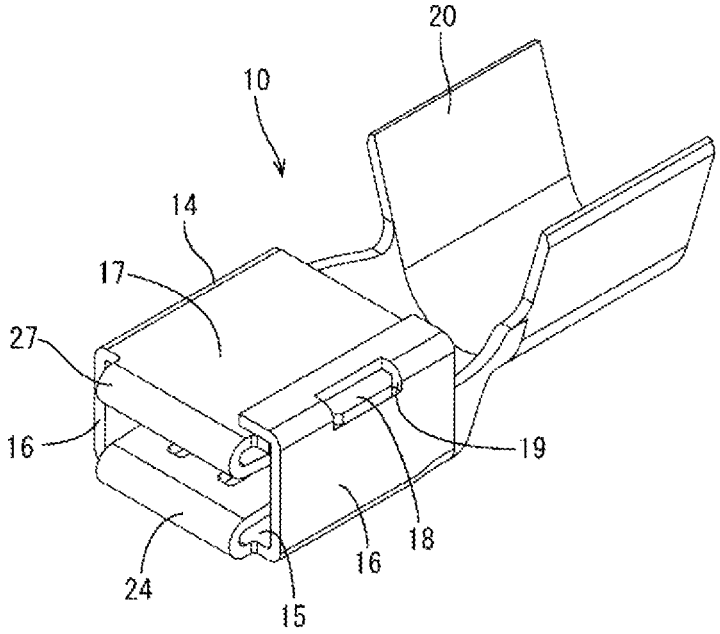
FIG. 2 is a perspective view of the female terminal viewed obliquely from front.
Figure 3:
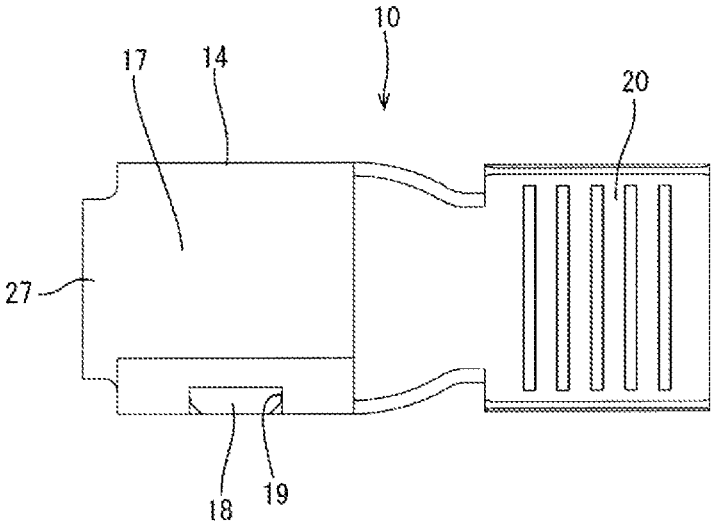
FIG. 3 is a plan view of the female terminal.
Figure 4:
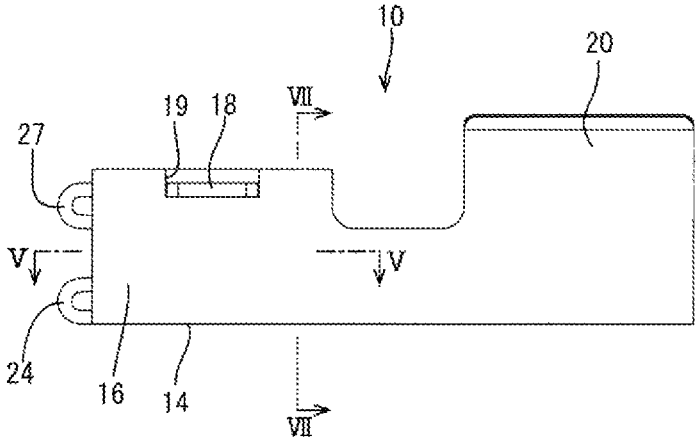
FIG. 4 is a side view of the female terminal.

The female terminal 10 is formed by press-working a metal plate material into a predetermined shape. The female terminal 10 includes a tubular portion 14 into which the male tab 12 of the male terminal 11 is to be inserted. As shown in FIGS. 2 to 4, the tubular portion 14 is substantially in the form of a rectangular tube open in a front-back direction. The tubular portion 14 is formed by configuring a plurality of peripheral walls into a rectangular tube shape, and these peripheral walls include a bottom wall 15, a pair of side walls 16 standing upward from both side edges of the bottom wall 15 and a ceiling wall 17 facing the bottom wall 15.

The ceiling wall 17 is formed by being bent substantially at a right angle at the upper end edge of one of the pair of side walls 16 toward the other side wall 16. A locking portion 18 is formed on a side end edge of the ceiling wall 17 and inserted into a locking hole 19 formed on the other side wall 16. A side end edge of the other side wall 16 is folded onto the upper surface of the ceiling wall 17. In this way, the tubular portion 14 is held to have the rectangular tube shape.

A wire barrel 20 extends behind the bottom wall 15. As shown in FIG. 1, a core 22 exposed from an insulation coating 22 at an end of a wire 13 is connected to this wire barrel 20. The wire barrel 20 is swaged and crimped to the core 22.

(First Resilient Pieces 23)

A first base end portion 24 is formed to project on the front end edge of the bottom wall 15. The first base end portion 24 is folded inwardly (rearwardly) of the tubular portion 14 from the front end edge of the bottom wall 15. As shown in FIG. 4, the first base end portion 24 slightly projects forward from the front end edge of the tubular portion 14.

Figure 5:
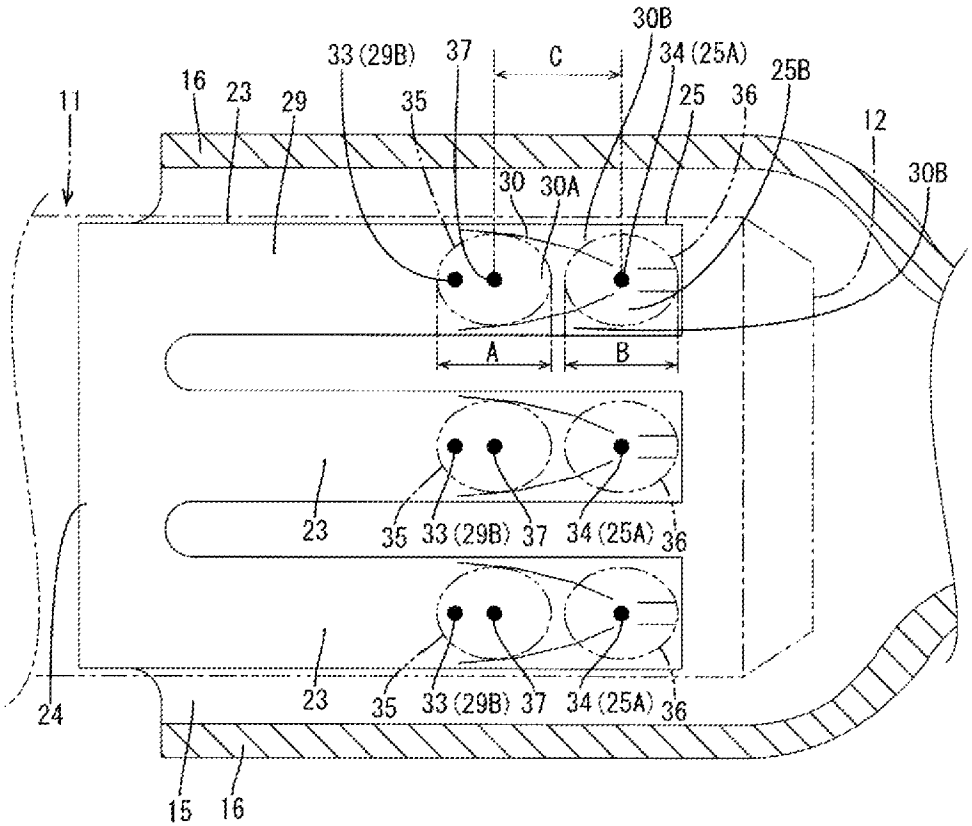
FIG. 5 is a section along V-V of FIG. 4.
Figure 9:
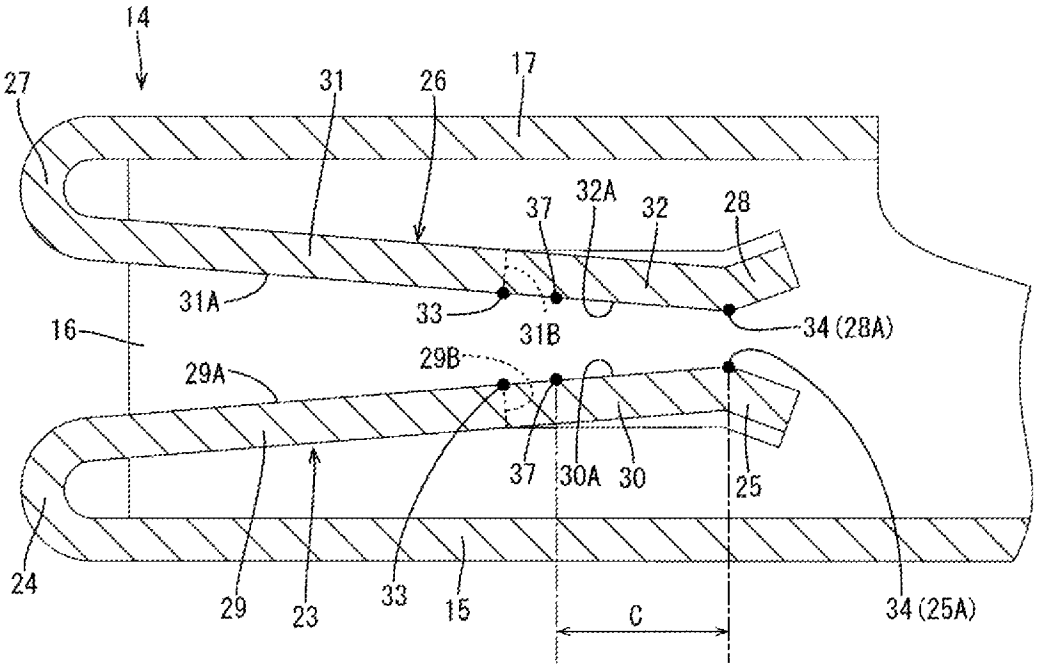
FIG. 9 is a section showing a state where resilient pieces are at an initial position.

As shown in FIG. 5, a plurality of (three in this embodiment) first resilient pieces 23 arranged side by side while being spaced apart in a direction intersecting with an inserting direction of the male terminal 11 are formed to extend inwardly (rearwardly) of the tubular portion 14 on the rear end edge of the folded first base end portion 24. As shown in FIG. 9, the first resilient piece 23 extends straight in a cantilever manner from the first base end portion 24 when viewed laterally. A first contact portion 25 is formed on an extending end part of this first resilient piece 23 and resiliently contacts the male terminal 11. For example, silver plating is applied to the first contact portion 25.

Lengths of the respective first resilient pieces 23 in the front-back direction are substantially equal. Further, widths of the respective first resilient pieces 23 in a direction (hereinafter, referred to as a width direction) perpendicular to the inserting direction of the male terminal 11 are substantially equal. Further, an interval is substantially equal between each pair of adjacent first resilient pieces 23. Thus, the plurality of first resilient pieces 23 are arranged at equal intervals substantially over the entire width of the tubular portion 14.

Figure 6:
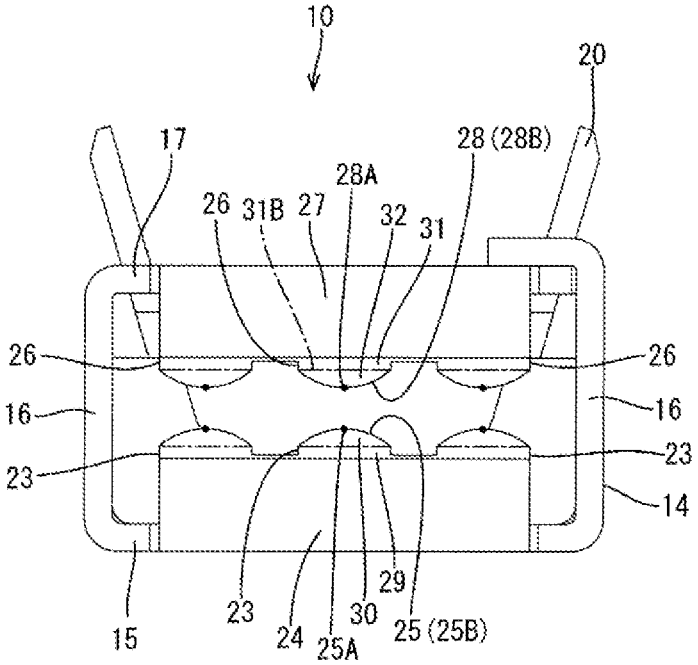
FIG. 6 is a front view of the female terminal.
Figure 7:
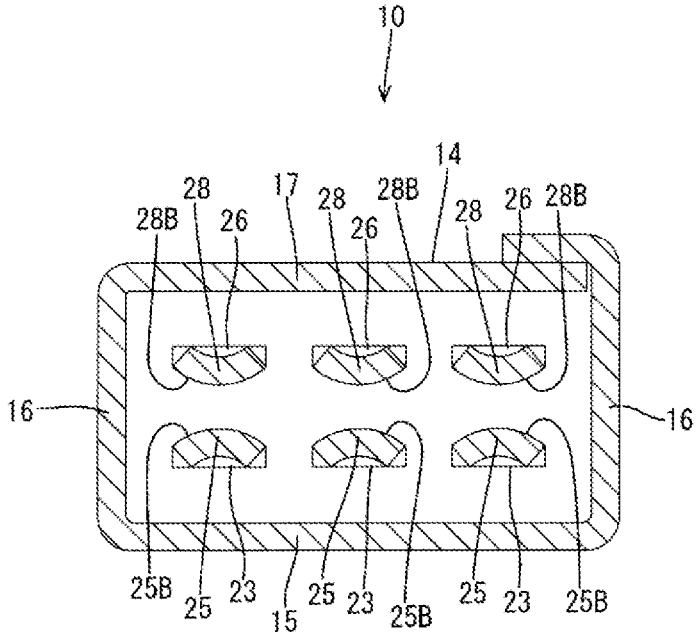
FIG. 7 is a section along VII-VII of FIG. 4.
Figure 8:
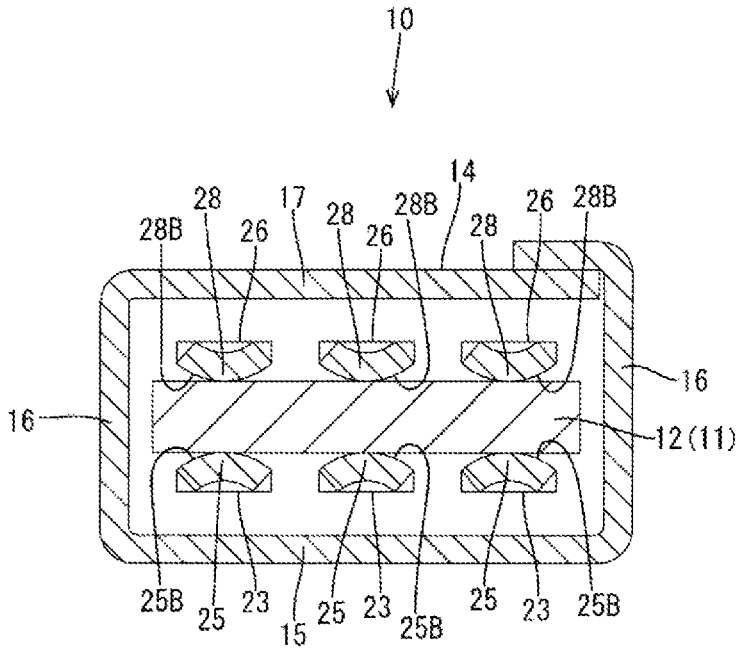
FIG. 8 is a section showing a properly connected state of a male terminal and the female terminal at the same cutting position as in FIG. 7.

As shown in FIG. 7, a contact edge 25B of the first contact portion 25 with the male terminal 11 is arcuate. As shown in FIG. 6, one first contact portion 25 is formed on each first resilient piece 23. Further, as shown in FIG. 7, the first contact portion 25 is formed over the entire width of the first resilient piece 23. In this way, the contact edge 25B of the first contact portion 25 is in point contact with the male terminal 11 in a wide range in response to a twisting movement of the male terminal 11 and a contact state is not suddenly changed by the twisting movement of the male terminal 11.

(Second Resilient Pieces 26)

A second base end portion 27 is formed to project on the front end edge of the ceiling wall 17. The second base end portion 27 is folded inwardly (rearwardly) of the tubular portion 14 from the front end edge of the ceiling wall 17. As shown in FIG. 4, the second base end portion 27 slightly projects forward from the front end edge of the tubular portion 14.

As shown in FIG. 5, a plurality of (three in this embodiment) second resilient pieces 26 arranged side by side while being spaced apart in a direction intersecting with the inserting direction of the male terminal 11 are formed to project inwardly (rearwardly) of the tubular portion 14 on the rear end edge of the folded second base end portion 27. As shown in FIG. 9, the second resilient piece 26 extends straight in a cantilever manner from the second base end portion 27 when viewed laterally. A second contact portion 28 is formed on an extending end part of this second resilient piece 26 and resiliently contacts the male terminal 11. For example, silver plating is applied to the second contact portion 28.

Lengths of the respective second resilient pieces 26 in the front-back direction are substantially equal. Further, widths of the respective second resilient pieces 26 in a direction (hereinafter, referred to as a width direction) perpendicular to the inserting direction of the male terminal 11 are substantially equal. Further, an interval is substantially equal between each pair of adjacent second resilient pieces 26. Thus, the plurality of second resilient pieces 26 are arranged at equal intervals substantially over the entire width of the tubular portion 14.

As shown in FIG. 7, a contact edge 28B of the second contact portion 28 with the male terminal 11 is arcuate. As shown in FIG. 6, one second contact portion 28 is formed on each second resilient piece 26. Further, as shown in FIG. 7, the second contact portion 28 is formed over the entire width of the second resilient piece 26. In this way, the contact edge 28B of the second contact portion 28 is in point contact with the male terminal 11 in a wide range in response to a twisting movement of the male terminal 11 and a contact state is not suddenly changed by the twisting movement of the male terminal 11.

As shown in FIG. 6, the first base end portion 24 and the first resilient pieces 23 and the second base end portion 27 and the second resilient pieces 26 are vertically symmetrically formed. This causes the first contact portions 25 of the first resilient pieces 23 and the second contact portions 28 of the second resilient pieces 26 to be arranged to face each other (see FIG. 7).

(First Line Contact Portions and First Gradually Changing Portions)

Figure 12:
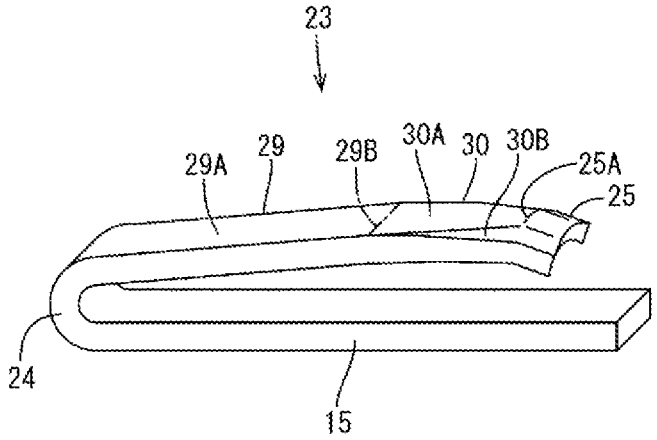
FIG. 12 is a perspective view of a first resilient piece viewed from an oblique direction.

As shown in FIG. 12, the first resilient piece 23 includes a first line contact portion 29 to be brought into line contact with the male terminal 11, the first contact portion 25 to be brought into point contact with the male terminal 11 and a first gradually changing portion 30 arranged between the first line contact portion 29 and the first contact portion 25 and having a contact area with the male terminal 11 gradually reduced toward the first contact portion 25. The first gradually changing portion 30 has a substantially isosceles triangular shape long in the front-back direction and is formed in an area extending from an end 29B of the first line contact portion 29 to a top 25A of the first contact portion 25. A cutting line cutting contact surfaces 29A, 30A of the first resilient piece 23 with the male terminal 11 in a longitudinal direction at a position passing through the top 25A of the first contact portion 25 along the inserting direction of the male terminal 11 is a straight line (see FIG. 9). Specifically, the first gradually changing portion 30 is formed in an area not beyond a flat surface flush with the contact surface 29A of the first line contact portion 29 (this flat surface and areas below it). Particularly, in this embodiment, the contact surface 29A of the first line contact portion 29, the contact surface 30A of the first gradually changing portion 30 and the top 25A of the first contact portion 25 are arranged side by side in a straight line in this order.

The contact surface 29A of the first line contact portion 29 and the contact surface 30A of the first gradually changing portion 30 are both flat surfaces and configured to be brought into line contact with the male terminal 11. A length of a contact edge with the male terminal 11 is constant in the inserting direction of the male terminal 11 on the contact surface 29A of the first line contact portion 29, whereas a length of a contact edge with the male terminal 11 is longest at the end 29B of the first contact portion 29, becomes gradually shorter toward the first contact portion 25 and is shortest on the first contact portion 25 on the contact surface 30A of the first gradually changing portion 30. As shown in FIG. 12, non-contact surfaces 30B not to be brought into contact with the male terminal 11 are formed on both sides of the first gradually changing portion 30 and these non-contact surfaces 30B are connected to the contact edge 25B of the first contact portion 25. Note that the first contact portion 25 extends obliquely downward while maintaining a cross-sectional shape at the contact edge 25B.

(Second Line Contact Portions and Second Gradually Changing Portions)

The second resilient piece 26 is configured to be vertically symmetrical with the first resilient piece 23 and includes a second line contact portion 31 to be brought into line contact with the male terminal 11, the second contact portion 28 to be brought into point contact with the male terminal 11 and a second gradually changing portion 32 arranged between the second line contact portion 31 and the second contact portion 28 and having a contact area with the male terminal 11 gradually reduced toward the second contact portion 28. Similarly to the first gradually changing portion 30, the second gradually changing portion 32 has a substantially isosceles triangular shape long in the front-back direction and is formed in an area extending from an end 31B of the second line contact portion 31 to a top 28A of the second contact portion 28. A cutting line cutting contact surfaces 31A, 32A of the second resilient piece 26 with the male terminal 11 in a longitudinal direction at a position passing through the top 28A of the second contact portion 28 along the inserting direction of the male terminal 11 is a straight line (see FIG. 9). Specifically, the second gradually changing portion 32 is formed in an area not beyond a flat surface flush with the contact surface 31A of the second line contact portion 31 (this flat surface and areas above it). Particularly, in this embodiment, the contact surface 31A of the second line contact portion 31, the contact surface 32A of the second gradually changing portion 32 and the top 28A of the second contact portion 28 are arranged side by side in a straight line in this order.

The contact surface 31A of the second line contact portion 31 and the contact surface 32A of the second gradually changing portion 32 are both flat surfaces and configured to be brought into line contact with the male terminal 11. A length of a contact edge with the male terminal 11 is constant in the inserting direction of the male terminal 11 on the contact surface 31A of the second line contact portion 31, whereas a length of a contact edge with the male terminal 11 is longest at the end 31B of the second contact portion 31, becomes gradually shorter toward the second contact portion 28 and is shortest on the second contact portion 28 on the contact surface 32A of the second gradually changing portion 32. Similarly to the first resilient piece 23, non-contact surfaces 32B not to be brought into contact with the male terminal 11 are formed on both sides of the second gradually changing portion 32 and these non-contact surfaces 32B are connected to the contact edge 28B of the second contact portion 28. Note that the second contact portion 28 extends obliquely downward while maintaining a cross-sectional shape at the contact edge 28B.

(Contact Mark and Slide Contact Mark)

Figure 11:
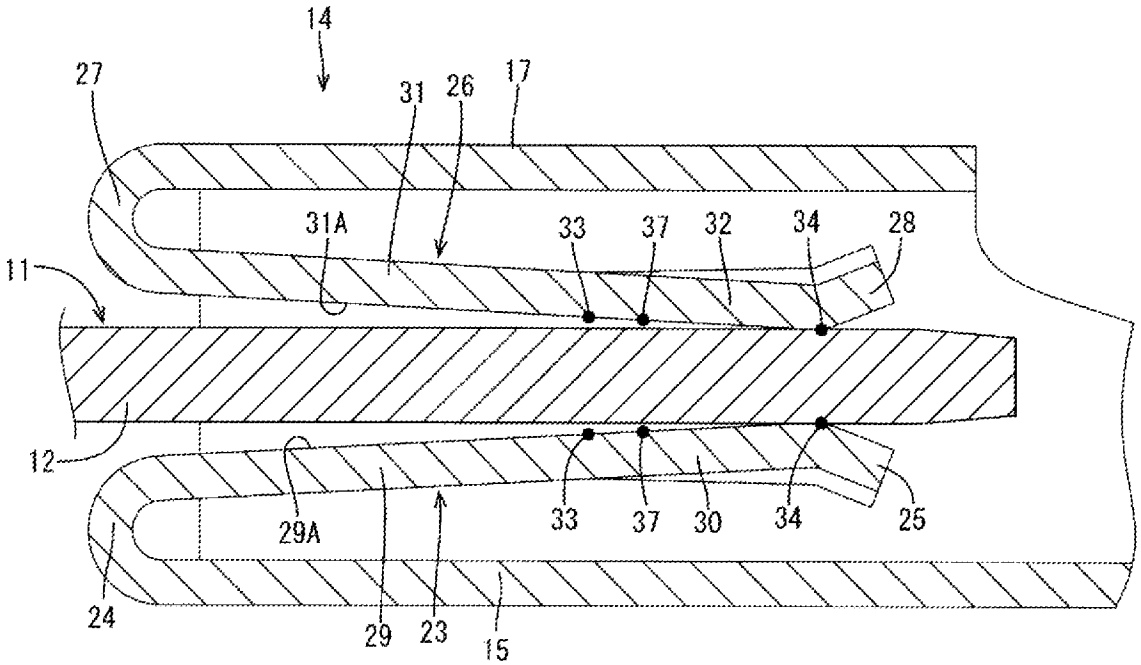
FIG. 11 is a section showing a state where the male terminal is in contact with each resilient piece at a slide contact point.

Each resilient piece 23, 26 is displaceable between an initial position shown in FIG. 9 and a deformation position shown in FIG. 11. The initial position is a position where the resilient piece is located before the male terminal 11 contacts each resilient piece 23, 26 and each resilient piece 23, 26 is in a natural state. Further, the deformation position is a position where each resilient piece 23, 26 is resiliently deformed by the contact of the male terminal 11 therewith and a contact pressure (contact load) is acting on the male terminal 11.

Figure 10:
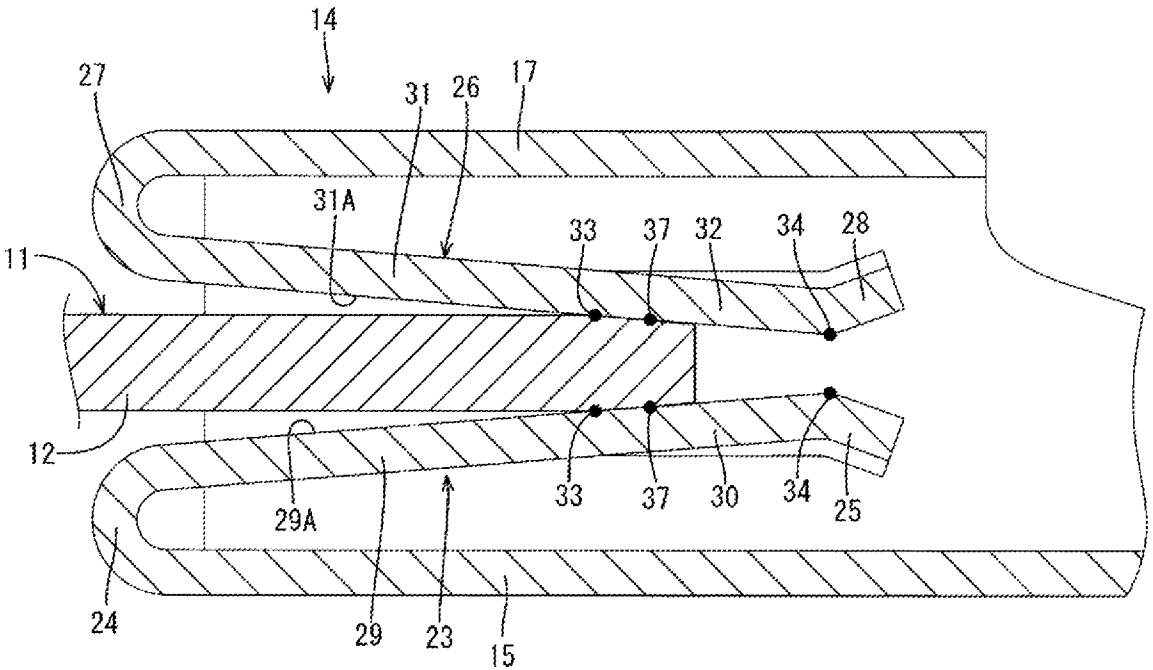
FIG. 10 is a section showing a state where the male terminal is in contact with each resilient piece at a contact start point.
Figure 13:
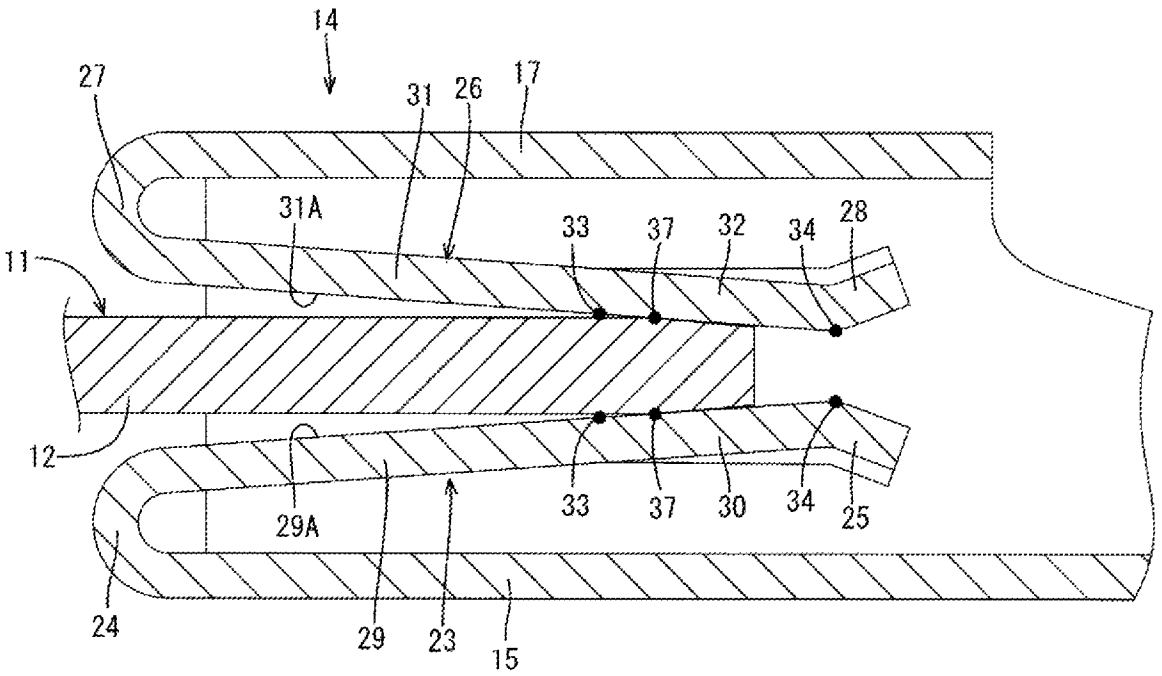
FIG. 13 is a section showing a state where the male terminal is in contact with each resilient piece at a point where a contact pressure peaks.
Figure 14:
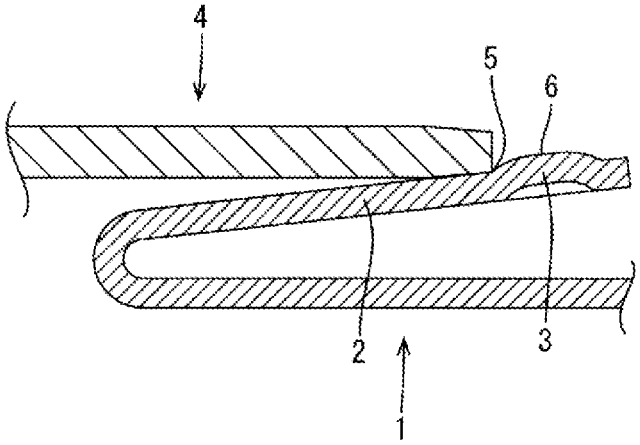
FIG. 14 is a section showing a state where a male terminal butts against a skirt portion of a projection.

A point where the male terminal 11 starts contacting each resilient piece 23, 26 located at the initial position as shown in FIG. 10 is set as a contact start position 33, and a point where the male terminal 11 slides in contact with each resilient piece 23, 26 displaced to the deformation position as shown in FIG. 11 is set as a slide contact point 34. As shown in FIG. 13, the contact pressure peaks between the contact start point 33 and the slide contact point 34. A point where the contact pressure peaks is referred to as a point 37 where the contact pressure is maximized below. As shown in FIG. 5, a contact mark 35 shown in chain double-dashed line is formed around the point 37 where the contact pressure is maximized and a slide contact mark 36 shown in chain double-dashed line is formed around the slide contact point 34.

Here, when A denotes the size of the contact mark 35 in an arrangement direction of the contact mark 35 and the slide contact mark 26, B denotes the size of the slide contact mark 36 in the arrangement direction and C denotes a distance between centers of the contact mark 35 and the slide contact mark 36 in the arrangement direction (separation distance between the point where the contact pressure is maximized and the slide contact point 34 in this embodiment), the contact mark 35 and the slide contact mark 36 are arranged not to overlap each other so as to satisfy $C>(A+B)/2$.

In this embodiment, the contact start point 33 matches the end 29B, 31B of each line contact portion 29, 31 and the slide contact point 34 matches the top 25A, 28A of each contact portion 25, 28. Thus, by arranging the contact mark 35 and the slide contact mark 36 at a distance from each other, it can be suppressed that plating wear occurs at each contact portion 25, 28 by repeated insertion and withdrawal of the male terminal 11. In this way, an increase of contact resistance caused by the insertion and withdrawal of the male terminal 11 can be suppressed.

As described above, since the contact mark 35 and the slide contact mark 36 are arranged not to overlap each other in this embodiment, an increase of contact resistance can be suppressed as compared to the case where a contact mark and a slide contact mark overlap each other, i.e. the contact mark and the slide contact mark are arranged very close to each other.

When A denotes the size of the contact mark 35 in the arrangement direction of the contact mark 35 and the slide contact mark 26, B denotes the size of the slide contact mark 36 in the arrangement direction and C denotes the distance between the centers of the contact mark 35 and the slide contact mark 36 in the arrangement direction, a configuration satisfying $C>(A+B)/2$ may be adopted.

According to this configuration, the size A of the contact mark 35 and the size B of the slide contact mark 36 may be, for example, measured in advance and the distance C between the centers may be set based on the measured sizes A, B. Then, the shapes of the resilient pieces 23, 26 may be appropriately set based on the distance C between the centers.

The technique disclosed by this specification is not limited to the above described and illustrated embodiment. For example, the following various modes are also included.

Although the contact mark 35 and the slide contact mark 36 are both shaped to be elliptical in the above embodiment, the shapes of the contact mark and the slide contact mark are not limited to elliptical shapes. Further, if the contact mark and the slide contact mark are irregularly shaped, C>(A+B)/2 may not be satisfied. However, even in such a case, the contact mark and the slide contact mark have only to be arranged not to overlap each other.

Although the female terminal 10 in which each contact portion 25, 28 is not formed by embossing is illustrated in the above embodiment, even a female terminal including embossed contact portions may be adopted if a contact mark and a slide contact mark do not overlap each other.

LIST OF REFERENCE SIGNS

10 . . . female terminal
11 . . . male terminal
23 . . . first resilient piece
26 . . . second resilient piece
33 . . . contact start point
34 . . . slide contact point
35 . . . contact mark
36 . . . slide contact mark
37 . . . point where contact pressure is maximized.

The invention claimed is:

1. A female terminal for use with a male terminal having a specified plate thickness, comprising:

a first resilient piece to be resiliently brought into contact with the male terminal, the first resilient piece being displaceable between an initial position where the first resilient piece is located before being contacted by the male terminal and a deformation position where the first resilient piece has been deformed resiliently by contact of the male terminal therewith;

the first resilient piece includes a first line contact portion to be brought into line contact with the male terminal, a first contact portion to be brought into point contact with the male terminal and a first gradually changing portion arranged between the first line contact portion and the first contact portion and having a contact area with the male terminal gradually reduced toward the first contact portion; and a second contact portion at a position on the female terminal facing the first contact portion; wherein the deformation position is a position where a distance between the first contact portion and the second contact portion is equal to a plate thickness of the male terminal; and a contact mark formed in a place around a point where a contact pressure given by the contact of the male terminal with the first resilient piece located at the initial position is maximized and extending from the line contact portion to the gradually changing portion and a slide contact mark formed around the first contact portion by slide contact of the male terminal with the first contact portion when the first resilient piece is displaced to the deformation position are arranged not to overlap each other.

2. The female terminal of claim 1, wherein, when A denotes a size of the contact mark in an arrangement direction of the contact mark and the slide contact mark, B denotes a size of the slide contact mark in the arrangement direction and C denotes a distance between centers of the contact mark and the slide contact mark in the arrangement direction, C>(A+B)/2 is satisfied.

3. The female terminal fitting of claim 2, further comprising a second resilient piece opposed to the first resilient piece, the second contact portion being formed on the second resilient piece.

4. The female terminal fitting of claim 3, wherein the second resilient piece further includes a second line contact portion to be brought into line contact with the male terminal and a second gradually changing portion arranged between the second line contact portion and the second contact portion and having a contact area with the male terminal gradually reduced toward the second contact portion.

* * * * *